US005416459A

United States Patent [19]

Ida et al.

[11] Patent Number: 5,416,459

[45] Date of Patent: May 16, 1995

[54] IGNITION COIL DEVICE FOR ENGINE

[75] Inventors: Yasuhiko Ida; Makoto Sakamaki, both of Saitama, Japan

[73] Assignee: Toyo Denso Kabushiki Kaisha, Tokyo, Japan

[21] Appl. No.: 124,408

[22] Filed: Sep. 20, 1993

[30] Foreign Application Priority Data

Sep. 24, 1992 [JP] Japan ..... 4-305799

[51] Int. Cl.[6] ..... H01F 27/02

[52] U.S. Cl. ..... 336/96; 336/107; 336/178; 336/198; 336/208

[58] Field of Search ..... 336/90, 96, 105, 107, 336/178, 192, 198, 234, 208

[56] References Cited

U.S. PATENT DOCUMENTS 4,763,094 9/1988 Kojima ..... 336/92
4,926,152 5/1990 Ito et al. ..... 336/90
5,008,643 4/1991 Heritier-Best ..... 336/96
5,015,984 5/1991 Vialaneix ..... 336/197
5,032,814 7/1991 Badaud ..... 336/65
5,109,209 4/1992 Ida et al. ..... 336/96
5,257,611 11/1993 Chapekis et al. ..... 123/634

*Primary Examiner*—Leo P. Picard
*Assistant Examiner*—L. Thomas
*Attorney, Agent, or Firm*—Lyon & Lyon

[57] ABSTRACT

An engine igniting coil device wherein an I-type core fitted in a hollow portion of a primary coil bobbin and a U-type core are arranged to oppose at their end faces, each other at a specified gap therebetween to form a closed magnetic circuit. The primary coil bobbin with the I-type core has a core holding portion integrally formed thereon for attaching thereto an end portion of the U-type core and the core holding portion also serves as an anti-cracking cover. This cover can accurately determine the positions of both cores and can effectively prevent initiation of cracking in the potting resin injected and cured in the coil case.

10 Claims, 8 Drawing Sheets

IGNITION COIL DEVICE FOR ENGINE

BACKGROUND OF THE INVENTION

The present invention relates to an engine igniting coil device.

Recently, there has been developed such an engine igniting coil device which comprises one coil case wherein a plurality of coil units selected in accordance with the quantity of engine cylinders are arranged without using a distributor and integrally molded by potting with insulating material such as epoxy resin and the like.

In the ignition coil device, each coil unit is composed of a primary coil bobbin incorporating a center core with a primary coil in its hollow portion and a secondary coil bobbin coaxially fitted thereon with a connecting core disposed outside the coil bobbin so as to face, at both its end faces with a specified gap to respective end faces of the center core to form a closed magnetic circuit therebetween.

The above-mentioned coil unit has no means for determining the position of the connecting core in relation to the center core mounted in the hollow portion of the primary coil bobbin when the connecting core is disposed to form a closed magnetic circuit. Consequently, positioning error may occur, resulting in decreasing the effective facing area of these two cores and/or variation of the face-to-face gap therebetween.

The coil unit of the prior art is such that an exposed core portion extending from the primary coil bobbin is covered with a cover made of relatively flexible material, e.g., polypropylene to prevent heat cracking of resin injected and cured around the extending core portion by absorbing heat stress possibly produced in the core portion. However, the core cover material has poor adhesion to the potting epoxy resin, resulting in producing a small gap between them.

Drawbacks of the conventional ignition coil device are as follows:

Accurate face-to-face mounting of a center core and a connecting core is hardly achieved. Mismatching of end faces of these cores (with reduced effective facing area) and variation of a gap therebetween may cause degrading of magnetic characteristic of the cores forming a closed magnetic circuit.

Displacement of opposing end faces of a center core and a connecting core in a coil unit may occur, making it difficult to mount a coil unit in a coil case.

A gap may be produced between a core cover and potting resin therearound, wherefrom cracking in the cured resin may initiate.

SUMMARY OF THE INVENTION

Accordingly, an object of the present invention is to provide an engine ignition coil wherein a center core and a connecting core can be accurately disposed at their end faces to each other without reducing the effective facing area of the cores and/or causing a variation of a gap therebetween to assure necessary magnetic characteristic of the cores forming a closed magnetic circuit.

Another object of the present invention is to provide an engine igniting coil device wherein a coil unit can be easily mounted in a coil case by eliminating the possibility of mismatching in face-to-face mounting of a connecting core and a center core.

A further object of the present invention is to provide an engine igniting coil device wherein the possibility of forming a gap between a core cover and thermosetting resin therearound is eliminated inhibit cracking in the resin.

The above-mentioned objects of the present invention are achieved as follows:

In each coil unit used in the ignition coil device, an Z-type core mounted in a hollow portion of a primary coil bobbin and a U-type core outside the bobbin are arranged to oppose each other at their end faces with a specified gap therebetween to form a closed magnetic circuit. The primary coil bobbin has a core holding part integrally formed thereon, by which the end faces of the U-type core is correctly positioned relative to the end faces of the I-type core.

To prevent cracking in the potting resin portion, coil units are previously covered at exposed portions of their cores with material having a good adhesion to the Dotting resin, and then they are disposed in a coil case and integrally potted with the resin injected therein in a melted state.

In this case, the core holding portion of each coil unit is formed of a material having a good adhesion to the potting resin, which is used as a crack preventing cover.

Figure 1:
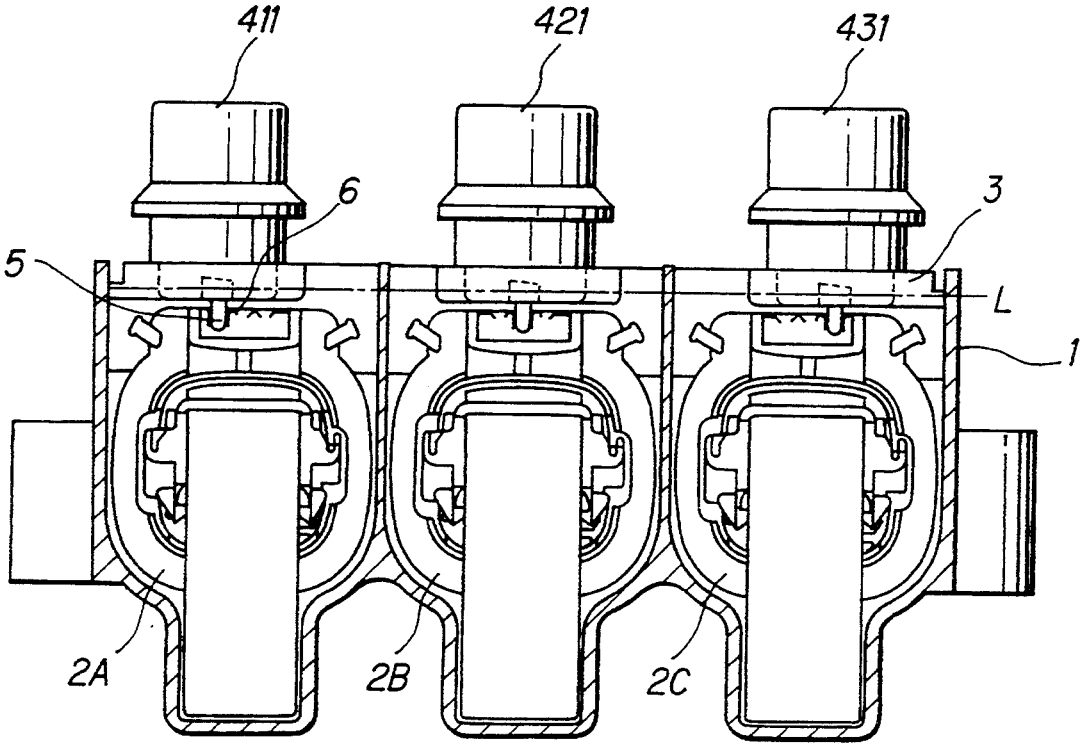
FIG. 1 is a sectional front view of an engine igniting coil device embodying the present invention.

Through the above-mentioned drawings, like parts are shown with like reference numerals as follows: a coil case 1, a coil unit 2, a coil cover 3, a high-voltage terminal socket 4, a low-voltage terminal socket 7, a primary coil bobbin 10. a core holding portion 101, a stopper portion 102, a bore 103, an I-type core 11, a spring lug 111, a secondary coil bobbin 12, a U-type core, a core cover 14, protrusion 18 and cured resin 19.

DESCRIPTION OF THE PREFERRED EMBODIMENTS

The preferred embodiments of the present invention will now be described in detail by way of example and with reference to the accompanying drawings.

Figure 2:
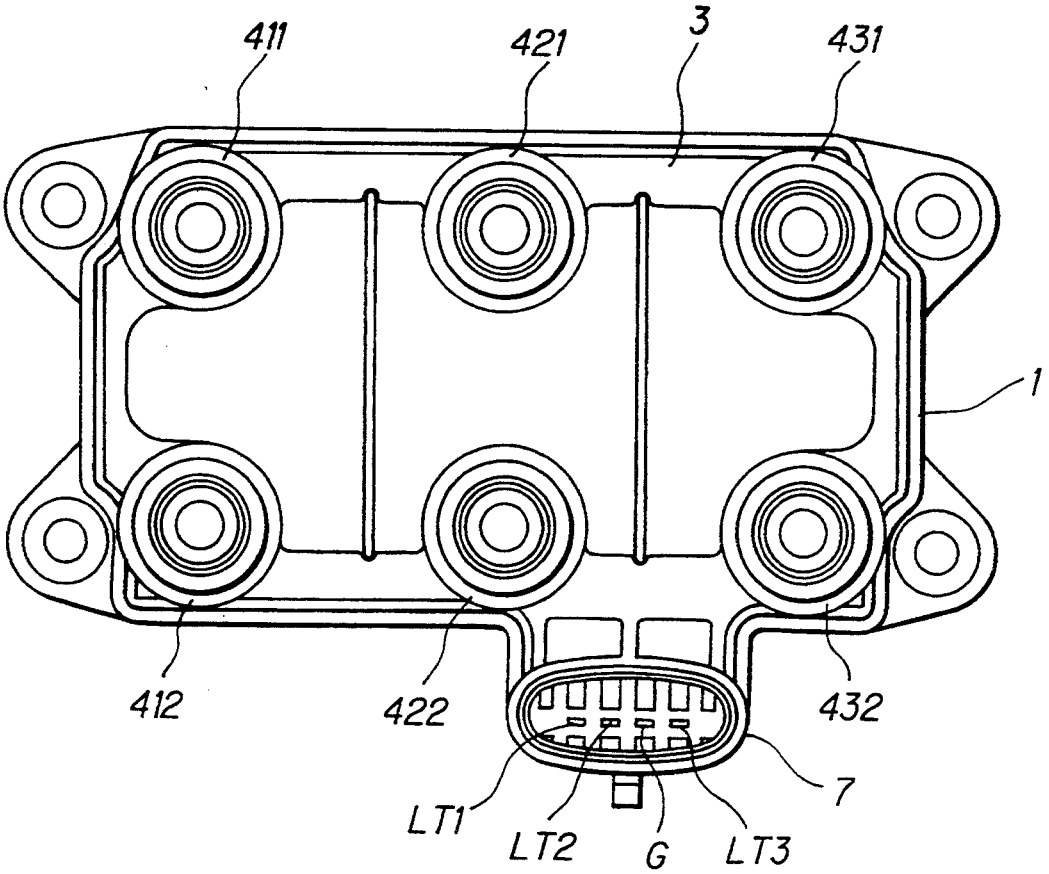
FIG. 2 is a plan view of the engine igniting coil device shown in FIG. 1

As shown in FIGS. 1 and 2, an engine igniting coil device according to the present invention comprises three coil units 2A, 2B and 2C arranged in a coil case 1 and a coil cover 3 which, holding therein high-voltage terminal sockets 4 (411, 412, 421, 422, 431, 432), is fitted in the coil case 1 and the sockets are integrally potted therein with insulating resin, e.g., epoxy resin which is injected in a melted state and cured to form a single device.

When the coil cover 3 with high-voltage terminal sockets mounted therein is fitted in the coil case 1, pins 5 protruding from the tip-potions of the high-voltage terminal sockets 4 are inserted into corresponding receptacles 6 provided on the coil units 2 to make the electrical connections between the sockets 4 and the coil units 2.

Low-voltage terminal sockets 7 of the coil units 2 are integrally formed on the coil cover 3.

Figure 3:
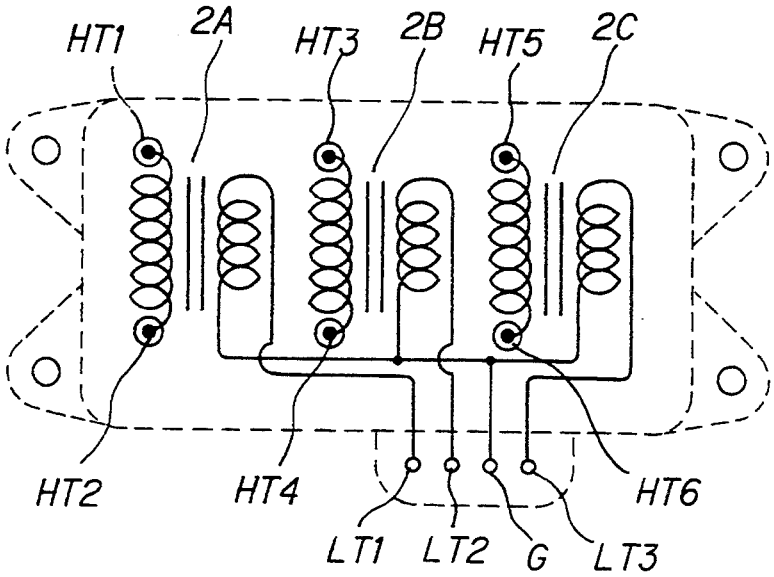
FIG. 3 is a view showing electric connections of the engine igniting coil device shown in FIG. 1.

FIG. 3 shows an electrical connection diagram of the ignition coil device, wherein characters HT1–HT6 designate secondary-side high-voltage terminals of the coil units 2, characters LT1–LT3 designate primary-side low-voltage terminals of the coil units 2 and character G designates a ground terminal commonly used for grounding the coil units.

Figure 4:
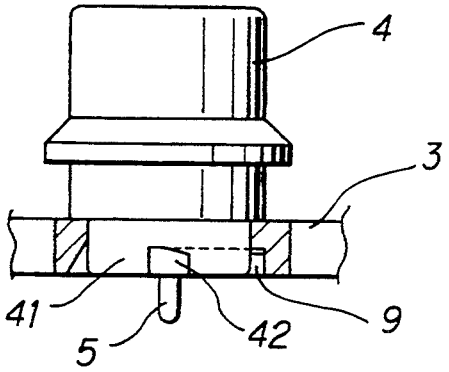
FIG. 4 is a sectional front view of a socket portion of a high-voltage terminal mounted in a coil cover.
Figure 5:
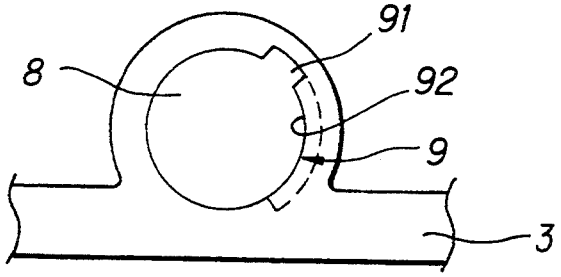
FIG. 5 is a top plan view of a hole made in a the coil cover for mounting therein the socket portion of a high voltage terminal.
Figure 6:
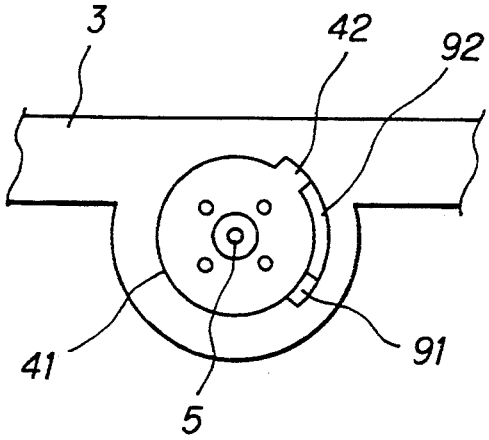
FIG. 6 is a rear view of a socket portion of high-voltage terminal to be inserted in the cover portion.

The high-voltage terminal sockets 4 are attached to the coil cover 3 in such a way that a tip portion 41 of a socket of each coil unit may be inserted into a hole 8 made in a specified place of the coil cover 3 and may engage at its protrusion 42 with a step 9 formed in a hole 8 for temporarily fixing the socket in the coil cover as shown in FIGS. 4 to 6.

As shown in FIGS. 5 and 6, the tip of the socket 41 is inserted into the hole in such a way that a protrusion 42 formed at the socket tip 41 passes through a notch 91 formed at the step portion 9 of the hole 8, and the socket 4 is then turned to lock the protrusion 42 at the lower side of the step 92 of the step portion 9.

Figure 7:
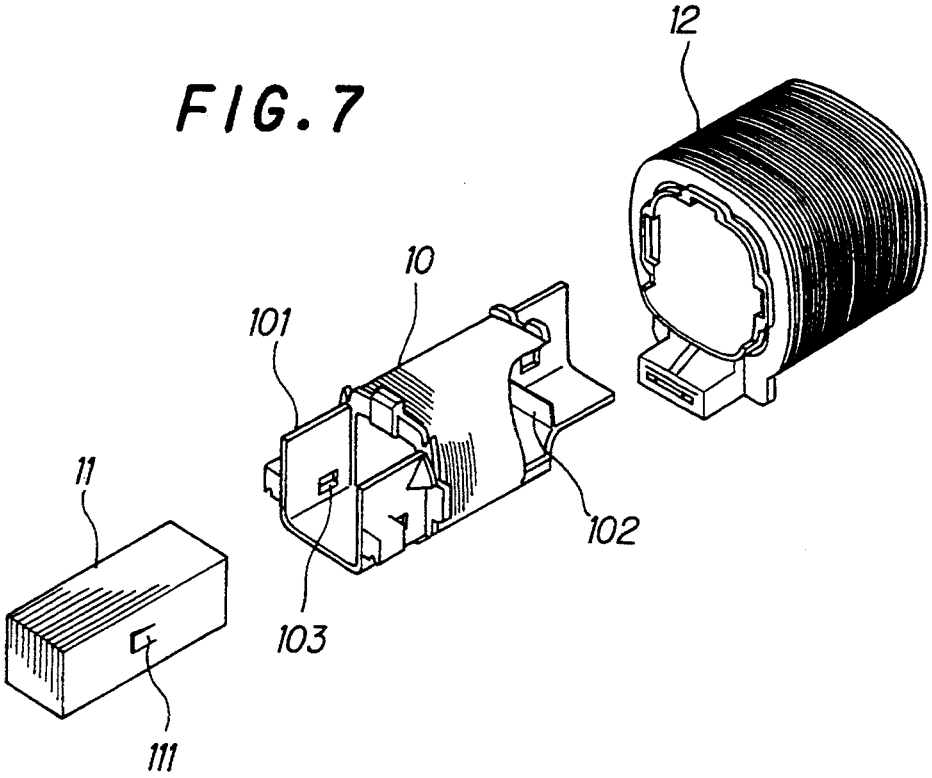
FIG. 7 is an exploded perspective view of a coil unit consisting of a primary coil bobbin, a secondary coil bobbin and an I-type core mountable in the primary coil bobbin.
Figure 8:
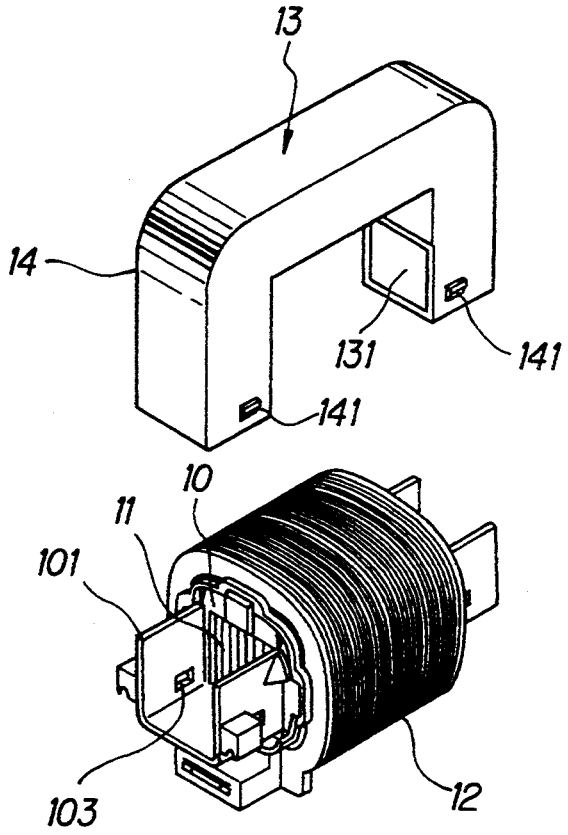
FIG. 8 is an exploded perspective view of a coil unit consisting of a primary coil bobbin, a secondary coil bobbin, an I-type core assembly and a U-type core mountable on the I-type core assenble.

The thus constructed device according to the present invention is featured by construction of each coil unit 2 as follows:

As shown in FIGS. 7 and 8, a primary coil bobbin 10 includes an I-type core 11 in its hollow portion and has a secondary coil bobbin 12 fitted externally thereon. A U-type core is fitted at each of its end portions in a core holding portion 101 integrally formed on the primary coil bobbin 10.

The I-type core 11 consisting of a laminated core has a spring lug 111 formed by cutting and bending up a part of an exterior sheet of the laminated core. The core holding portion 101 has a stopper portion 102 for positioning the I-type core 11 to be inserted into the primary coil bobbin 10 (see FIG. 9). The I-type core 11 is inserted into a bore (hollow portion) of the primary coil bobbin 10, with the spring lug 111 being compressed by the bobbin's inner wall, until the core at its tip abuts the stopper portion 102 and is firmly fixed in the specified position by the spring lug 111 biting the inner wall of the bobbin 10 (see FIG. 10).

Figure 11:
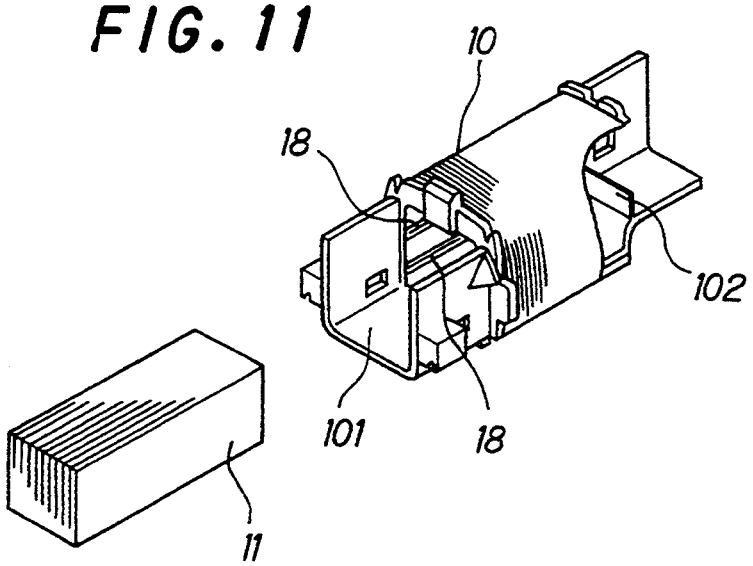
FIG. 11 is a perspective view of another embodiment of an engine igniting coil device including a primary coil bobbin and an I-type of core.

In another embodiment, the primary coil bobbin 10 has inverted vee guides 18 formed on its inner wall in the direction of inserting the I-type core as shown in FIG. 11. The I-type core 11 is inserted into a hollow portion of the primary coil bobbin 10, flattening the guides 18, until the core at its tip abuts the stopper portion 102 and is firmly fixed in the specified position therein.

The above-mentioned means are effective to firmly fix the I-type core 11 at the correct position in the hollow portion of the primary coil bobbin 10.

Figure 12:
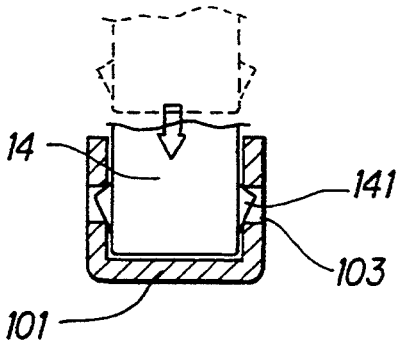
FIG. 12 is a sectional front view showing hooking portions projecting from both ends of a core cover, which is fitted in a bore formed in a coil holding portion of a primary coil bobbin.

The U-type core 13 is covered with a cover 14 made of relatively flexible material, e.g., polypropylene, but being exposed at both end faces, to absorb the possible thermal deformation of the core. The core cover 14 has hooks 141 protrusively formed at both end portions and it may be fixed to the core holding portion 101 by fitting the hooks 141 in the holes 103 formed in the core holding portion 101 (see FIG. 12).

The U-type core 13 in the fitted state opposes with a specified or predetermined gap at both faces 131, respectively, the corresponding faces of the I-type core 11 to form a core of a closed magnetic circuit.

Figure 9:
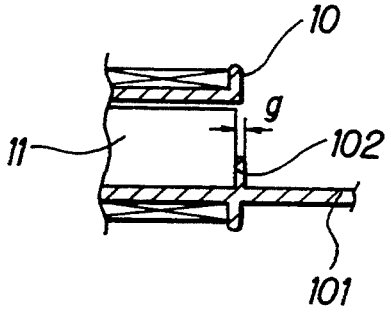
FIG. 9 is a sectional side view of a stopper port ion formed on a core holding portion for positioning an I-type core insertable into a coil bobbin.
Figure 10:
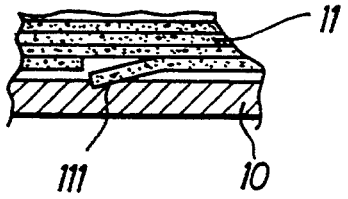
FIG. 10 is a sectional side view of a spring lug of an I-type core, which bits an internal side wall of a primary coil bobbin.

In this case, the stopper portion 102 serves as a spacer for keeping a specified or predetermined gap "g" between an end face of the I-type core 11 and an opposing inwardly facing face 131 of the U-type core 13, as shown in FIG. 9.

According to the present invention, it is possible to easily assemble the I-type core 11 and the U-type core 13 at the correct relative positions to form a closed magnetic circuit, keeping a specified or predetermined gap "g" and with no need for any additional operation like caulking.

Figure 13:
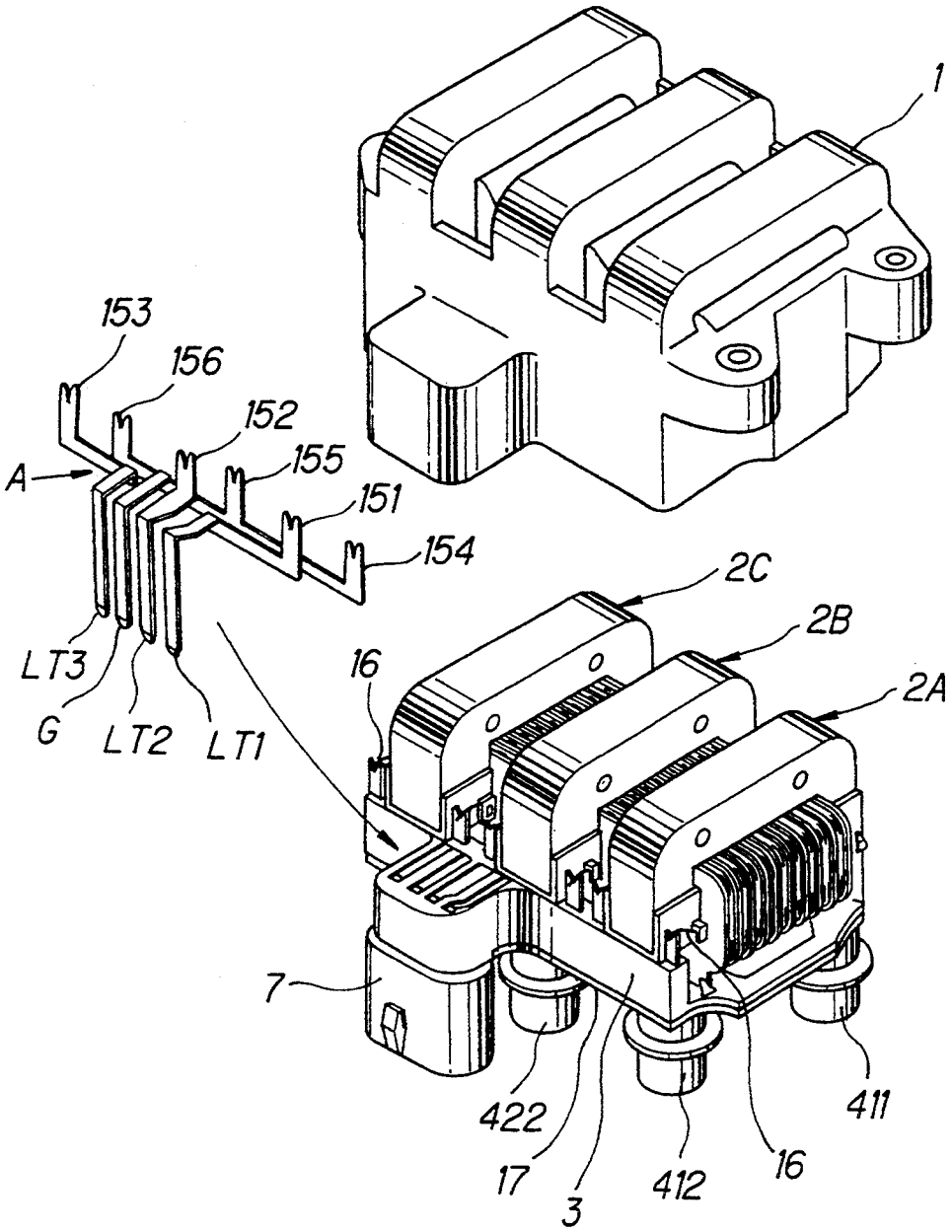
FIG. 13 is an exploded perspective view showing the assembled engine igniting coil device shown in FIG. 11.

FIG. 13 is a view for explaining how to assemble an ignition coil device according to the present invention. A coil cover 3 with high-voltage terminal sockets 4 (411, 412, 421, 422, 431, and 432) previously mounted therein is further provided with coil units 2 (2A, 2B and 2C) at the specified respective places thereof in such a way that a high-voltage terminal pin 5 protruding from the tip of a high-voltage terminal socket is inserted into a receptacle 6 provided at each coil unit 2 (see FIG. 1). Lead wires 16 from the primary coil units 2 are connected to corresponding contact ends 151–156 connected respectively to primary-side terminals LT1–LT3 and a ground terminal "G" of a low-voltage terminal socket 7 and then a coil case 1 is mounted on the assembled coil cover 3.

The contact ends 151–156 connected to the terminals LT1–LT3 and the ground terminal G in the low-voltage terminal sockets 7 are constructed as shown in detail at "A" in FIG. 13 and they are partly embedded, with their free ends being exposed, in a groove previously formed in the coil cover 3.

The assembled ignition coil device in the condition shown in FIG. 1 is filled with melted resin through an opening in the coil cover 3 to a level L shown by a dotted line, whereby all the components are united into a single unit.

Figure 14:
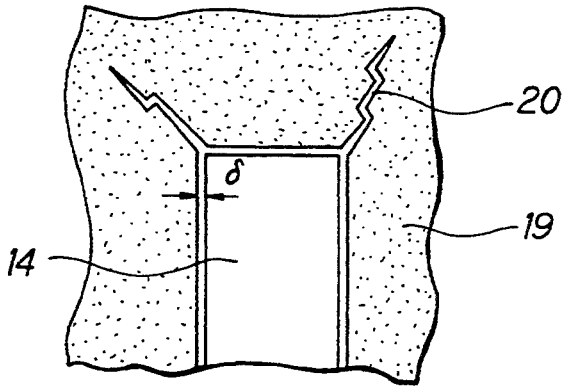
FIG. 14 (PRIOR ART)
FIG. 14 shows initiation of cracks in a resin I layer, starting from a gap formed between a coil cover and the resin layer surrounding a core cover.
Figure 15:
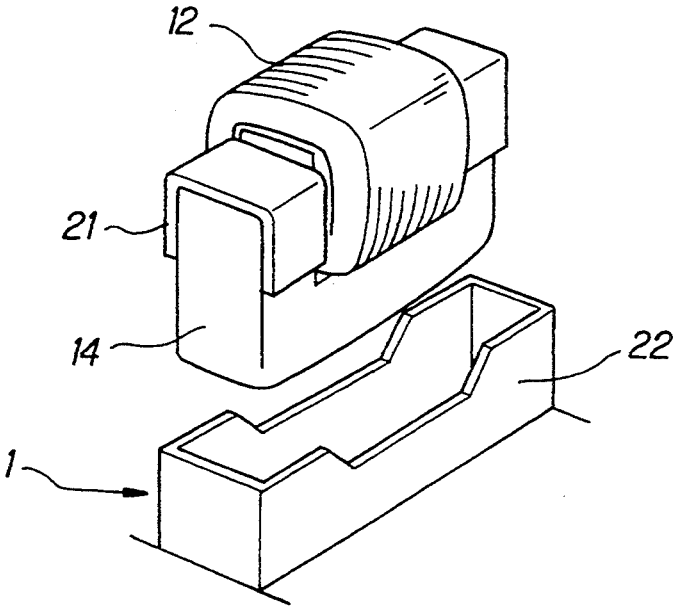
FIG. 15 is a perspective view showing a coil unit provided with a crack prevention cover and portion of a coil case for mounting the coil unit therein.
Figure 16:
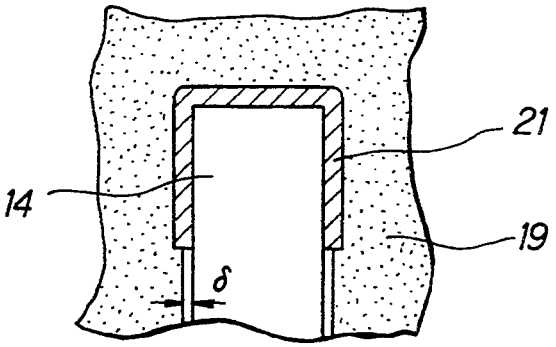
FIG. 16 is a sectional front view of a portion of cover for preventing initiation of cracks in a potting resin layer.

In the case of the prior art, since the material of the core cover 14 has poor adhesion to potting resin material, e.g., epoxy resin, a gap "d" 8 may be formed between the core cover 14 and the cured potting resin 19 as shown in FIG. 14. Consequently, stress may concentrates at corners of the core cover 14 to induce cracking 20 in the cured resin portion. To solve the above-mentioned problem, the present invention provides that a cover 21 made of material (e.g., polybutyleneterephthalate) which has good affinity (adhesion) to the potting resin (e.g., epoxy resin) and less flexible than that of the core cover 14, is applied, as shown in FIGS. 15 and 16, to a portion of the core cover 14, wherefrom cracking is apt to initiate. By doing so, as shown in FIG. 16, the cover 21 and the cured resin 19 therearound tightly adhere to each other to eliminate the possibility of stress concentration at the corners of the core cover 14 and therefore to effectively prevent the crack initiation in the cured resin.

Among cracks that may initiate from a gap "d" 8 between the core cover 14 and the cured resin 19, particular attention shall be given to cracking in the cured resin 19 near to the high-voltage terminal pins 5, that can be effectively prevented by applying the protection cover 21.

The present invention proposes that the core holding portion 101 integrally formed on the primary coil bobbin 10 shown in FIG. 8 shall also serve as the crack preventing cover 21 shown in FIG. 16.

In the case shown in FIG. 15, the coil case 1 has a core container 22 formed therein of material having good adhesion to potting resin (e.g., epoxy resin) to enclose therein the remaining portion of the coil cover in combination with the crack prevention cover 21. As described above, an engine igniting coil unit according to the present invention is so constructed that an I-type core fitted in hollow portion of a primary coil bobbin and a U-type core may correctly oppose each other at their end faces with a specified or predetermined gap therebetween to form a closed magnetic circuit and the U-type core's ends are attached to core holding portions integrally formed on the primary coil bobbin.

This assures that both cores can be correctly positioned with respect to each other without mismatching their end faces and deviation of the gap therebetween. The thus constructed coil ignition device is easy to assemble with reliable characteristics and stable construction and is adequate for mass production.

Since an exposed portion of cores externally extending from a primary coil bobbin is covered with a core cover made of relatively flexible material being capable of absorbing thermal stress that may be possibly caused in the core and then a coil unit is mounted in a coil case, melted resin is injected into the coil case to form an integral unit with cured resin.

In the potting process, the coil cover is covered with a crack prevention cover made of material having good adhesion to the potting resin, thereby eliminating the possibility of crack initiation from a gap formed between the core cover and surrounding resin layer due to poor adhesion to each other, that has been encountered in the prior art device. Accordingly, a high-quality igniting coil device can be obtained.

The present invention provides that a core holding portion is formed of material having good adhesion to the resin to be injected therearound and is also used as the crack prevention cover. This makes it possible to effectively improve dielectric strength of the device by eliminating the possibility of crack initiation in a resin portion from the core to the high-voltage portion and at the same time to effectively simplify the construction of the device.

What is claimed is:

1. An engine igniting coil device having at least one coil unit comprising a primary coil bobbin having a hollow portion, an I-type core positioned in said hollow portion and having opposite end faces, a secondary coil bobbin coaxially mounted on said primary coil bobbin, a U-type core having projecting ends with inwardly facing end faces, said U-type core being disposed over said primary coil bobbin with said inwardly facing end faces opposed to said opposite end faces of said I-type core at a predetermined gap therebetween to form a closed magnetic circuit, a core holding portion integrally formed on said primary coil bobbin and receiving said projecting ends of said U-type core for determining relative positions of the I-type core and the U-type core, an inverted vee guide formed along a wall surface of said hollow portion of the primary coil bobbin in the direction of inserting said I-type core into said hollow portion, and a stopper for locking a tip of the I-type core provided on the core holding portion to firmly fix the I-type core in the primary coil bobbin by inserting the I-type core into the hollow portion, thereby flattening the convex guide formed on said wall surface, until the tip of the I-type core abuts the stopper.

2. An engine igniting coil device having at least one coil unit comprising a primary coil bobbin having a hollow portion, an I-type core positioned in said hollow portion and having opposite end faces, a secondary coil bobbin coaxially mounted on said primary coil bobbin, a U-type core having projecting ends with inwardly facing end faces, said U-type core being disposed over said primary coil bobbin with said inwardly facing end faces opposed to said opposite end faces of said I-type core at a predetermined gap therebetween to form a closed magnetic circuit, a core holding portion integrally formed on said primary coil bobbin and receiving said projecting ends of said U-type core for determining relative positions of the I-type core and the U-type core, said I-type core made of laminated iron sheets and having a spring lug formed by cutting and bending up a part of an outside iron sheet, and a stopper for locking a tip of the I-type core insertable into the hollow portion of the primary coil bobbin formed on said core holding portion to firmly fix the I-type core in the primary coil bobbin by inserting the core into the hollow portion, causing compression of the spring lug, until the tip of the core abuts the stopper.

3. An engine igniting coil device as claimed in claim 1 or 2, characterized in that the stopper also serves as a spacer for keeping said predetermined gap between said opposed end faces of the I-type core and the U-type core.

4. An engine igniting coil device having at least one coil unit comprising a primary coil bobbin having a hollow portion, an I-type core positioned in said hollow portion and having opposite end faces, a secondary coil bobbin coaxially mounted on said primary coil bobbin, a U-type core having projecting ends with inwardly facing end faces, said U-type core being disposed over said primary coil bobbin with said inwardly facing end faces opposed to said opposite end faces of said I-type core at a predetermined gap therebetween to form a closed magnetic circuit, a core holding portion integrally formed on said primary coil bobbin and receiving said projecting ends of said U-type core for determining relative positions of the I-type core and the U-type core, said U-type core being covered with a core cover in such a way that only both projecting ends of the U-type core are exposed for facing end faces of the I-type core, and the U-type core is secured to the core holding portion by engaging a hook formed on the core cover at the projecting ends of the U-type core with a hole made in the core holding portion.

5. An engine igniting coil device as claimed in claim 4, characterized in that said coil unit is mounted in a coil case after covering the core cover with a crack prevention cover made of material having good adhesion to potting resin and then a melted resin is injected into the coil case to form single device.

6. An engine igniting coil device as claimed in claim 5, characterized in that said core holding portion provided on the primary coil bobbin also serves as a crack prevention cover.

7. An engine igniting coil device having at least one coil unit comprising a primary coil bobbin having a hollow portion, an I-type core positioned in said hollow portion and having opposite end faces, a secondary coil bobbin coaxially mounted on said primary coil bobbin, a U-type core having projecting ends with inwardly facing end faces, said U-type core being disposed over said primary coil bobbin with said inwardly facing end faces opposed to said opposite end faces of said I-type core to form a closed magnetic circuit, a core holding portion integrally formed on said primary coil bobbin and receiving said projecting ends of said U-type core for mounting said U-type on said primary coil bobbin, and a stopper provided on said primary coil bobbin at one end of said hollow portion for engaging one of said opposite end faces and one of said inwardly facing end faces for determining relative positions of said I-type core and said U-type core and providing a predetermined gap between said one opposite end face and said one inwardly facing end face.

8. An engine igniting coil device as claimed in claim 7, characterized in that an inverted vee guide is formed along a wall surface of said hollow portion of said primary coil bobbin in the direction of inserting said I-type core into said hollow portion for firmly fixing said I-type core in said primary coil bobbin by inserting said I-type core into said hollow portion thereby flattening said inverted vee guide formed on said wall surface.

9. An engine igniting coil device as claimed in claim 7, characterized in that said I-type core is made of laminated iron sheets and has a spring lug formed by cutting and bending up a part of an outside iron sheet for engaging a wall surface of said portion.

10. An engine igniting coil device as claimed in claim 7, characterized in that said I-type core is covered with a core cover in such a way that only both projecting ends of said U-type core are exposed for facing end faces of said I-type core, and said U-type core is secured to the core holding portion by a hook formed on said core cover engaging a hole in the core holding portion.

* * * * *